United States Patent [19]

Yokoyama et al.

[11] Patent Number: 4,972,792

[45] Date of Patent: Nov. 27, 1990

[54] LATERAL STABILIZATION DEVICE FOR ENTIRELY SUBMERGED TYPE HYDROFOIL CRAFT

[75] Inventors: Fumitaka Yokoyama; Kotaro Horiuchi, both of Iwata, Japan

[73] Assignee: Yamaha Hatsudoki Kabushiki Kaishi, Iwata, Japan

[21] Appl. No.: 344,692

[22] Filed: Apr. 28, 1989

[30] Foreign Application Priority Data

Apr. 30, 1988 [JP] Japan ..... 63-107884

[51] Int. Cl.[5] ..... B63B 1/28

[52] U.S. Cl. ..... 114/275; 114/281

[58] Field of Search ..... 114/275, 122, 281; 280/755

[56] References Cited

U.S. PATENT DOCUMENTS 2,892,435 6/1959 Ljungstrom ..... 114/122

3,804,048 4/1974 Cline ..... 114/281

*Primary Examiner*—Sherman Basinger

*Attorney, Agent, or Firm*—Ernest A. Beutler

[57] ABSTRACT

A stabilizing device for a hydrofoil type watercraft embodying a fully submerged hydrofoil. A flywheel is supported for precessive effect and is operatively connected to the steering shaft for effecting movement of the steering shaft and associated hydrofoil for generating a stability force on the hull in response to leaning thereof.

3 Claims, 3 Drawing Sheets

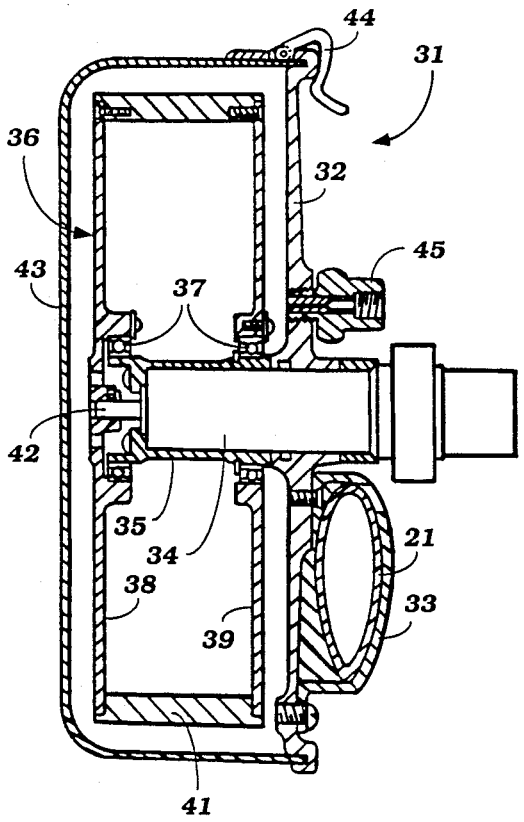
Figure 2
Figure 3
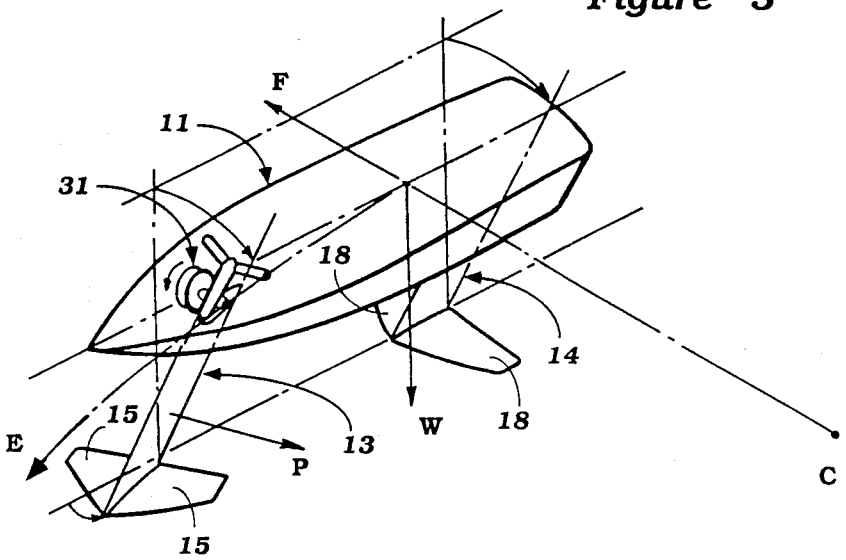

LATERAL STABILIZATION DEVICE FOR ENTIRELY SUBMERGED TYPE HYDROFOIL CRAFT

BACKGROUND OF THE INVENTION

This invention relates to a lateral stabilization device for a hydrofoil craft and more particularly to an improved arrangement for insuring automatic stabilization of this type of watercraft in response to leaning.

Hydrofoil type watercraft can be classified in one of two general types. The first of these types is of the entirely submerged type in which the hydrofoil or hydrofoils for the watercraft are always fully submerged during the watercraft operation. The other type of device is the water level penetration type in which the hydrofoil or hydrofoils have a generally V configuration inclined about an axis that extends longitudinally of the watercraft and in which the apex of the V is always submerged but the upper peripheral edges of the hydrofoil are normally out of the water when the watercraft is traveling in a straight ahead direction.

Frequently, conditions arise which cause the watercraft to lean relative to the water. When such leaning occurs, it is of course desirable to cause the hull to be brought back to its upright condition so as to insure stable operation. With the water lever penetration type of hydrofoil, the leaning of the watercraft will cause one blade of the hydrofoil to become more submerged and the other blade becomes less submerged. This difference in submersion causes a self-righting force to be generated that will cause the hull to return to its erect position. With the fully submerged type of hydrofoil, however, it is necessary for the operator to steer the watercraft in a way so that the hydrofoil will create this self-righting effect. Obviously, this presents certain disadvantages and requires the operator to maintain constant attention and also can cause difficulties in effecting steering.

This problem may be considered closely akin to the situation of riding a bicycle wherein when the bicycle tends to lean, the operator can return the bicycle back to its upright position by steering it in the proper direction. Devices have been provided for achieving automatic steering, however, these devices require gyro sensors or acceleration sensors who detect signals to transmit to an electric controller and actuator for effecting the necessary steering movement of the hydrofoil to cause stability of the hull. Such devices are, obviously, not only expensive but very cumbersome.

It is, therefore, a principal object of this invention to provide an improved stabilization device for a fully submerged type of hydrofoil craft.

It is a further object of this invention to provide an automatic stabilizing mechanism for a hydrofoil craft of the fully submerged type.

It is a further object of this invention to provide an improved, simplified and highly effective stabilization device for a hydrofoil craft of this type.

SUMMARY OF THE INVENTION

This invention is adapted to be embodied in a hydrofoil type of watercraft that is comprised of a hull and a steering shaft that is journaled relative to the hull for steering movement about a steering axis. A hydrofoil is affixed relative to the steering shaft and is adapted to be submerged during the operation of the watercraft and provides a hydrodynamic lift to the hull. In accordance with the invention, means are provided for effecting steering operation of the steering shaft in response to a leaning of the hull for effecting a righting force thereupon by the hydrofoil. This means comprises a flywheel that is supported for rotation relative to the steering axis about a rotational axis that is transversely disposed relative to the steering axis. Means are provided for rotating the flywheel about its rotational axis in such a direction that leaning of the watercraft creates a precessive effect on the steering shaft for steering the hydrofoil in a direction to cause self-righting of the hull.

BRIEF DESCRIPTION OF THE DRAWINGS

FIG. 2 is an enlarged cross-sectional view showing the stabilizing device of this embodiment.

FIG. 3 is a perspective view showing the watercraft and a vector diagram explaining how the self-righting effect is generated.

DETAILED DESCRIPTION OF THE PREFERRED EMBODIMENTS

Figure 1:
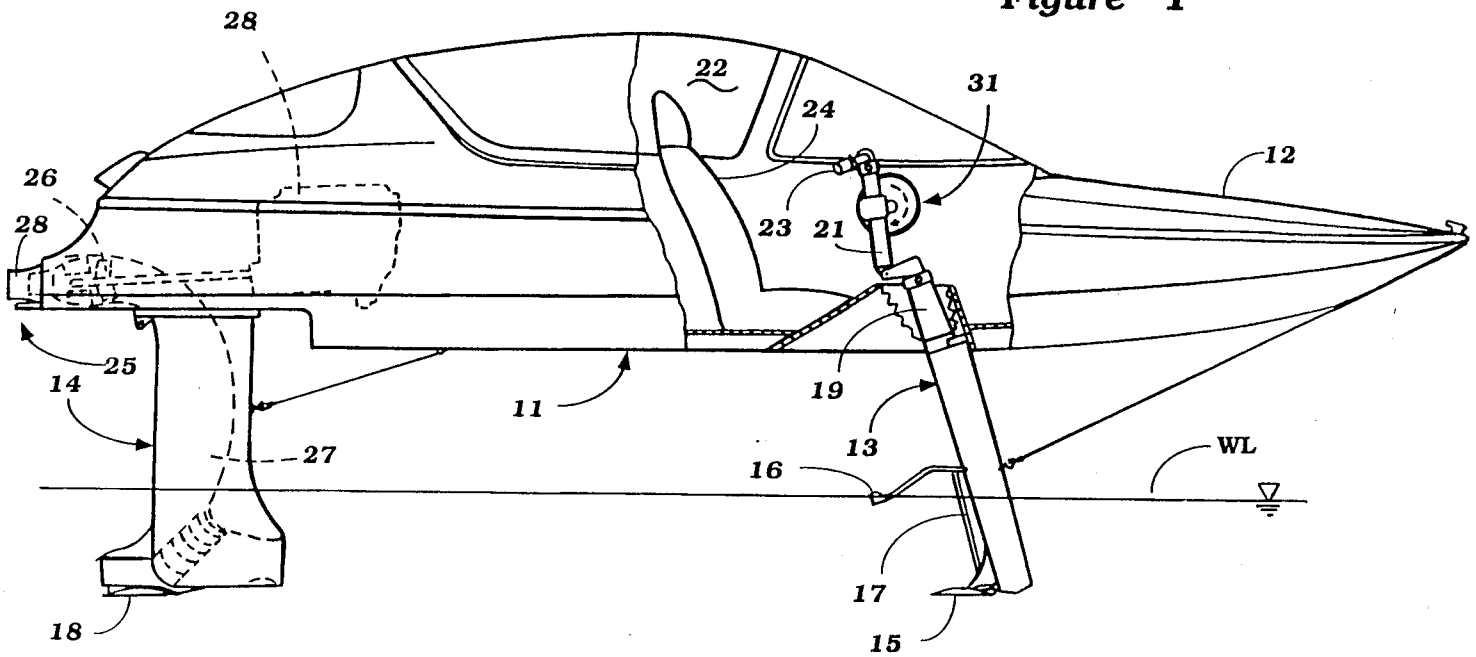
FIG. 1 is a side elevational view of a watercraft of the hydrofoil type constructed in accordance with an embodiment of the invention.

Referring first to FIG. 1, a jet propelled hydrofoil type of watercraft constructed in accordance with a first embodiment of the invention is identified generally by the reference numeral 11. The watercraft 11 is comprised of a hull 12. The hull 12 is supported for movement above the water line WL of the body water in which the watercraft is operated by means of a pair of front and rear supporting struts 13 and 14. The front supporting strut 13 is supported for steering movement about a steering axis that is generally vertically oriented and supports a hydrofoil device 15 at its lower end for generating a hydrodynamic lift on the hull 12. The angle of the hydrofoil 14 is adjustably controlled in order to maintain a predetermined height of the hull above the water level WL by means of a skimmer 16 that engages the water and which is coupled to the hydrofoil 15 by means of a a link 17. If the hull 12 tends to move downwardly, the skimmer 16 will pivot and pivot the hydrofoil 15 so as to created a further hydrodynamic lift so as to maintain a uniform water level.

In a similar manner, the rear support 14 carries a hydrofoil 18, which may be fixed in angle and which generates a hydrodynamic lift for the rear of the hull 14.

The front column 13 is supported for steering movement, as aforenoted, by means of a journal 19 carried by the hull 12. The steering column 13 is coupled to a steering shaft 21 that is supported within the hull 12 and specifically a passenger compartment 22 thereof. A handleaber assembly 23 is affixed to the upper end of the steering shaft 21 for steering the shaft 21, strut 13 and hydrofoil 15 for changing the direction of the watercraft. The handlebar 23 is positioned in proximity to an operator's seat 24 contained within the passenger compartment 22.

The watercraft 11 is propelled by means of a jet propulsion unit, indicated generally by the reference numeral 25 and which consists of an impeller 26 that draws water from the lower end of the rear strut 14 through a duct 27 and which discharges it through a nozzle 28 for propelling the watercraft 12 in a known manner. The impeller 26 is driven by an internal combustion engine 19 that is supported within the hull.

In accordance with the invention, there is provided a stabilizer assembly, indicated generally by the reference numeral 31 and shown in most detailed in FIG. 2, that tends to effect steering of the strut 13 and hydrofoil 15 so as to generate a righting force in the event the hull 12 tends to become displaced from its normal upright attitude. Referring specifically to FIG. 2, the stabilizer device 31 includes a mounting plate 32 that is affixed to the steering shaft 21 by means of a clamping arrangement 33. A drive motor, such as an electrical motor 34, is supported by a cylindrical extension 35 of the plate 32 and drives a flywheel assembly, indicated generally by the reference numeral 36 for rotation about an axis that extends generally transversely to the steering axis of the shaft 21. This angle need not be at 90° and hence the term "transversely" means that the axis of rotation crosses or extends at an angle to the direction of motion of the hydrofoil craft and the steering axis.

The flywheel assembly 36 is journaled on the cylindrical extension 35 by means of a pair of spaced apart bearings 37 and is comprised of a pair of spaced plates 38 and 39 that carry an annular inertial mass 41 at their periphery. The weight and size of the inertial mass 41 can be readily changed so as to compensate for variations in the weight and loading of the watercraft 11.

The flywheel 36 is rotatably coupled to an output shaft 42 of the motor 34 in a suitable manner and the area in which the flywheel 36 rotates is enclosed by means of a cover plate 43 that is held to the support plate 32 by one or more releasable clamps 44. The area within the cover plate 43 is evacuated by means of a vacuum pump (not shown) through a fitting 45 so as to reduce the air resistance and, accordingly, the power necessary to drive the flywheel 36.

Figure 4:
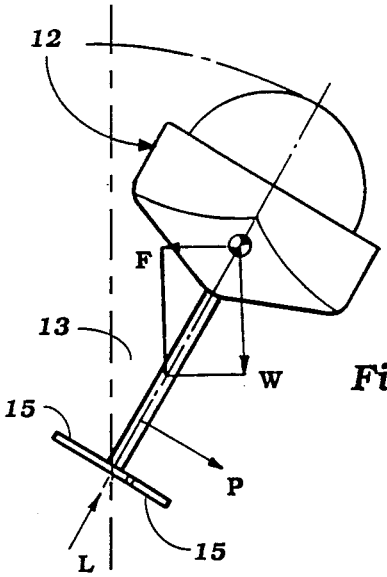
FIG. 4 is a front elevational view of the watercraft and the vector diagram under this condition.

FIGS. 3 and 4 are vector diagrams that illustrate how the device operates so as to maintain stabilization. In the event the hull 12 becomes displaced from the normal upright position, for example, to the left as shown in these figures, the weight or center of gravity will shift to the left of a vertical plane and cause a downward force W that creates a moment tending to cause the watercraft to become displaced. When this occurs, the precessive effect on the stabilizing device 31 will tend to cause it to rotate in a direction so as to create a hydrodynamic force P that tends to cause the watercraft to steer to the left along an arc E about a center C. This causes a centrifugal force F that causes an action to tend to restore the watercraft to its upright position. This can be achieved by manual steering of the shaft 21 in the direction noted, however, the action of the stabilizing device 31 tends to cause this steering movement to be effected automatically and hence the operator need not be responsible for fully maintaining the watercraft 11 in its stable condition.

Figure 5:
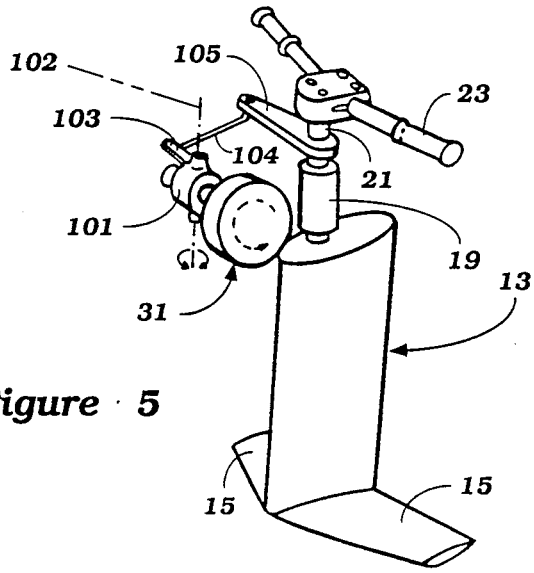
FIG. 5 is a partial perspective view showing another embodiment of the invention.

In the embodiment of the invention as thus far described, the stabilizing device 31 was directly connected to the steering shaft 21. However, it is possible to connect the stabilizing device 31 to the steering shaft 21 through some form of motion transmitting mechanism. In fact, such a connection can be advantageous since the use of an interconnecting linkage system can be employed so as to increase or decrease the effect of the stabilizing device on the steering shaft 21 and thus further reduce steering effort. Such an embodiment is shown in FIG. 5 and, in this figure, those components of the construction which are the same as the previously described embodiment have been identified by the same reference numerals and will not be described again, except insofar as is necessary to understanding the construction and operation of this embodiment.

In this embodiment, the stabilizing device 31 and specifically its outer housing and support plate 32 are affixed to a supporting member 101 which is, in turn, supported by the hull 12 of the watercraft for movement about an axis 102. Preferably, the axis 102 is parallel to the steering axis 21. However, it is important that the axis 102 is disposed so that the axis of rotation of the flywheel 36 of the stabilizing device 31 extends transversely to the steering axis of the shaft 21 and hull 12 as aforedescribed.

A level 103 is rigidly connected to the supporting device 101 and is connected by means of a link 104 to a further lever 105 which is, in turn, affixed for rotation with the steering shaft 21. As a result, when the watercraft hull 12 tends to lean to one side or the other, the precessive effect of the flywheel 36 will cuase a steering force to be exerted on the steering shaft 21 and steering column 13 so as to rotate the hydrofoil 15 in a direction to create a counterbalancing force that will tend to cause the watercraft to assume an erect position. In addition, the precessive effect of the flywheel will tend to assist steering initiated by the operator and create the stabilizing effect as aforenoted.

It should be readily apparent from the foregoing description, that the embodiments of the invention illustrated and described are particularly useful in assisting the steering movement of a hydrofoil type watercraft and, at the same time, insuring its stability. Although two embodiments of the invention have been illustrated and described, various changes and modifications may be made without departing from the spirit and scope of the invention, as defined by the appended claims.

We claim:

1. In a hydrofoil watercraft comprised of a hull, a steering shaft journaled relative to said hull for steering movement about a steering axis, and a hydrofoil affixed relative to said steering shaft and adapted to be submerged during the operation of said watercraft and providing a hydrodynamic lift to said hull, the improvement comprising means for effecting a steering of said steering shaft in response to the leaning of said hull providing a righting force thereupon by said hydrofoil comprising a flywheel, means for supporting said flywheel for rotation about an axis extending transversely to the axis of the steering shaft and for permitting precessive rotation of said flywheel about an axis substantially parallel to the axis of said steering shaft, and means for coupling said supporting means to said steering shaft for effecting a rotational movement upon said steering shaft in response to the percessive effect of said flywheel.

2. In a hydrofoil watercraft as set forth in claim 1 wherein the flywheel supporting device is affixed directly to the steering shaft.

3. In a hydrofoil watercraft as set forth in claim 1 wherein the flywheel supporting device is connected to the steering shaft by a linkage system.

* * * * *